US005667264A

United States Patent [19]

Tanahara

[11] Patent Number: 5,667,264

[45] Date of Patent: Sep. 16, 1997

[54] APPARATUS FOR ANIMAL WASTE COLLECTION

[76] Inventor: Steve F. Tanahara, 94-1192 Kahuahale St., Waipahu, Hi. 96797

[21] Appl. No.: 555,928

[22] Filed: Nov. 13, 1995

[51] Int. Cl.[6] ..... A01K 29/00; E01H 1/12

[52] U.S. Cl. ..... 294/1.4; 15/257.6

[58] Field of Search ..... 294/1.3–1.5, 19.1, 294/50.8, 50.9, 55, 103.1, 119.1; 15/104.8, 257.1, 257.4, 257.6, 257.7

[56] References Cited

U.S. PATENT DOCUMENTS

| | | | |
|---|---|---|---|
| 3,830,423 | 8/1974 | Prescott . | |
| 3,942,831 | 3/1976 | Sosnove | 294/1.4 |
| 3,986,744 | 10/1976 | Krogstad et al. . | |
| 4,200,321 | 4/1980 | Warkentin | 294/1.4 |
| 4,240,656 | 12/1980 | Eiffinger . | |
| 4,641,873 | 2/1987 | Nurnberger | 294/1.4 |
| 4,896,912 | 1/1990 | Parnell . | |
| 5,320,393 | 6/1994 | Cortinas | 294/1.4 |
| 5,540,470 | 7/1996 | Lu | 294/1.4 |

FOREIGN PATENT DOCUMENTS

| | | | |
|---|---|---|---|
| 2444155 | 3/1976 | Germany | 294/1.4 |

*Primary Examiner*—Dean Kramer

*Attorney, Agent, or Firm*—Michael I. Kroll

[57] ABSTRACT

An apparatus (10) for animal waste collection comprising a frame member (12). A disposable bag (14) is to receive animal waste (16) therein. An element (18) is for connecting a folded over mouth portion of the disposable bag (14) to the frame member (12) in a removable manner. An upright handle assembly (20) is also provided. A facility (22) is for coupling the frame member (12) with the disposable bag (14) to a bottom end of the upright handle assembly (20) in a removable manner. A person (24) can grasp the upright handle assembly (20) in a removable manner. A person (24) can grasp the upright handle assembly (20), position the frame member (12) with the disposable bag (14) adjacent animal waste (16) deposited upon the ground (26), scoop the animal waste (16) into the disposable bag (14), disengage the upright handle assembly (20) from the frame member (12) and separate the disposable bag (14) from the frame member (12) to get rid of the disposable bag (14) with the animal waste (16).

21 Claims, 2 Drawing Sheets

APPARATUS FOR ANIMAL WASTE COLLECTION

BACKGROUND OF THE INVENTION

1. Field of the Invention

The instant invention relates generally to excrement retrieval devices and more specifically it relates to an apparatus for animal waste collection.

2. Description of the Prior Art

Numerous excrement retrieval devices have been provided in prior art. For example, U.S. patents numbered U.S. Pat. No. 3,830,423 to Prescott; U.S. Pat. No. 3,986,744 to Krogstad et al.; U.S. Pat. No. 4,240,656 to Eiffinger and U.S. Pat. No. 4,896,912 to Parnell all are illustrative of such prior art. While these units may be suitable for the particular purpose to which they address, they would not be as suitable for the purposes of the present invention as heretofore described.

PRESCOTT, BEATRICE M.

DISPOSABLE PET EXCRETA CONTAINER

U.S. Pat. No. 3,830,423

This invention is a disposable pet excreta container of bag-like or box-like construction. Portions of one side of the container are extended to provide ears engaged by the feet of the user to hold the container in position on the ground. A flexible cord engages the opposite side of the container and upon upward force, holds the container open. A disposable member is provided for directing the excreta into the container.

KRUGSTAD, DAVID

NIGRO, GEORGE A.

REFUSE COLLECTION DEVICE

U.S. Pat. No. 3,986,744

A refuse collecting device which is designed particularly for dog or other animal waste or excrement embodies an open-ended, tubular, scoop-like body and has a flat bottom wall which constitutes a scoop proper and the forward edge of which is provided with comb-like teeth which enhances the pick-up action of the device when the latter is used on a lawn. A manipulating handle overlies the top wall of the tubular body and a combined closure plate and paddle member is hinged to the top wall of the body top wall and is spring-biased to a position wherein it extends across and fully closes the open front end of the body. A thumb piece which is secured to the combined closure plate and paddle member arches rearwardly over the handle and is accessible to the user's thumb whereby depression thereof causes the combined closure plate and paddle member to be swung forwardly and upwardly thus exposing the interior of the tubular body for excrement scooping purposes. Release of the thumb piece allows the member to swing downwardly and rearwardly and by way of a paddle action to slide or sweep the scooped excrement rearwardly into the open front end of the tubular body. An ordinary paper or plastic bag which is telescopically received over the open rear end of the tubular body and is held in position by a rubber band or other suitable releasable attaching means constitutes a disposable receptacle which receives successive scoopings each time the handle, and consequently, the device as a whole, is upended.

EIFFINGER, KARLHEINZ

APPARATUS FOR RETRIEVAL AND DISPOSAL OF ANIMAL EXCREMENTS

U.S. Pat. No. 4,240,656

Disclosed herein is an apparatus for the picking up and disposal of animal excrements in a hygienic and simple manner. The apparatus provides for one or more lined shovels to be attached to one end of a telescoping shaft. The shaft is provided with a handle, allowing its use as a walking stick. It is optionally provided with a wheel on the end. By placing the shovel end of the shaft on the ground, and depressing the other end of the shaft, the shaft telescopes, causing the shovels to be tilted from their normally upright position to a position in which they are horizontal with the ground and able to pick up the desired excrements. In order to select which of the shovels attached to the shaft is to be tilted to the ground, a pin and wing nut assembly is provided for each shovel. This assembly permits the coupling or decoupling of the individual shovel's tilting lever from the shaft.

PARNELL, VERNON A.

SANITARY METHOD AND APPARATUS FOR WASTE COLLECTION AND DISPOSAL

U.S. Pat. No. 4,896,912

A waste material collection and disposal apparatus includes a long-handled scoop and a long-handled scraper releasably coupled together with a carrying ring, and a supply of first and second flexible disposable bags, which may also be carried by means of a clip on the carrying ring. In use, a receptacle portion of the scoop and a blade portion of the scraper are respectively enclosed within first and second bags, which are then secured in a closed condition about the handles of the scoop and scraper with twister ties. The scraper is released from the carrying ring and used to scrape the waste material into the receptacle. Then the bags are untied and inverted for removing them for the scoop receptacle and scraper blade, respectively, and simultaneously enclosing therein collected waste material. The bags are then secured closed with the twister ties for disposal.

SUMMARY OF THE INVENTION

A primary object of the present invention is to provide an apparatus for animal waste collection that will overcome the shortcomings of the prior art devices.

Another object is to provide an apparatus for animal waste collection that contains a mechanism for the convenient hygienic retrieval of animal waste.

An additional object is to provide an apparatus for animal waste collection that is removably attached thereto for the proper disposal of the animal waste after the animal waste is placed within the disposable bag.

A further object is to provide an apparatus for animal waste collection that is simple and easy to use.

A still further object is to provide an apparatus for animal waste collection that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
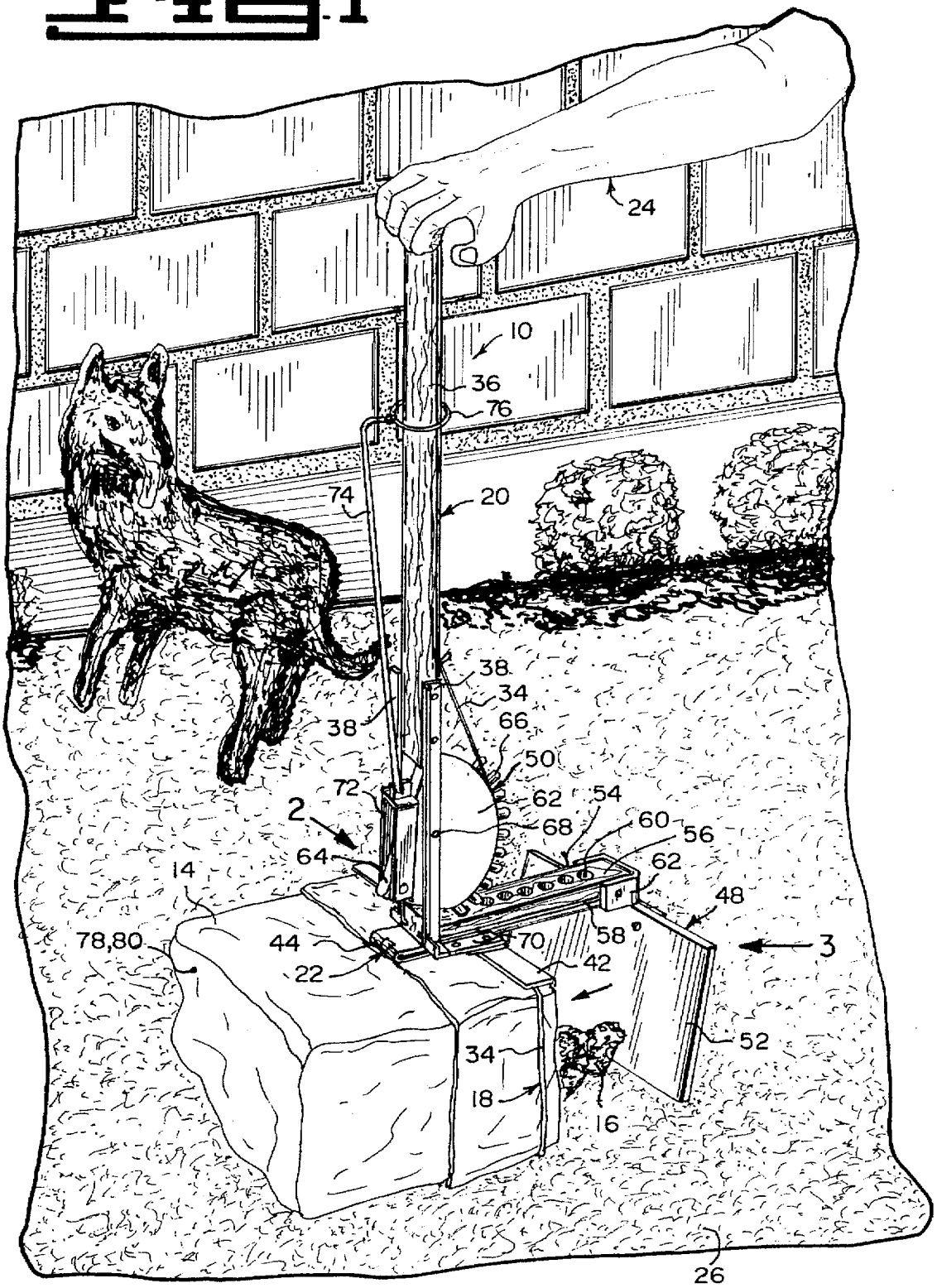
FIG. 1 is a rear perspective view showing the instant invention in use.
Figure 2:
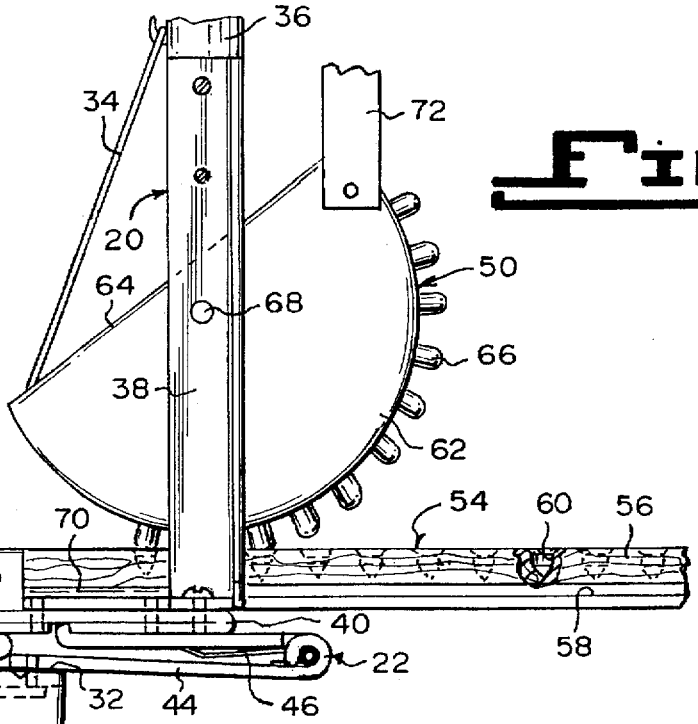
FIG. 2 is a side elevational view taken in the direction of arrow 2 in FIG. 1 in a closed position, with parts broken away in section and the plastic bag removed therefrom.
Figure 3:
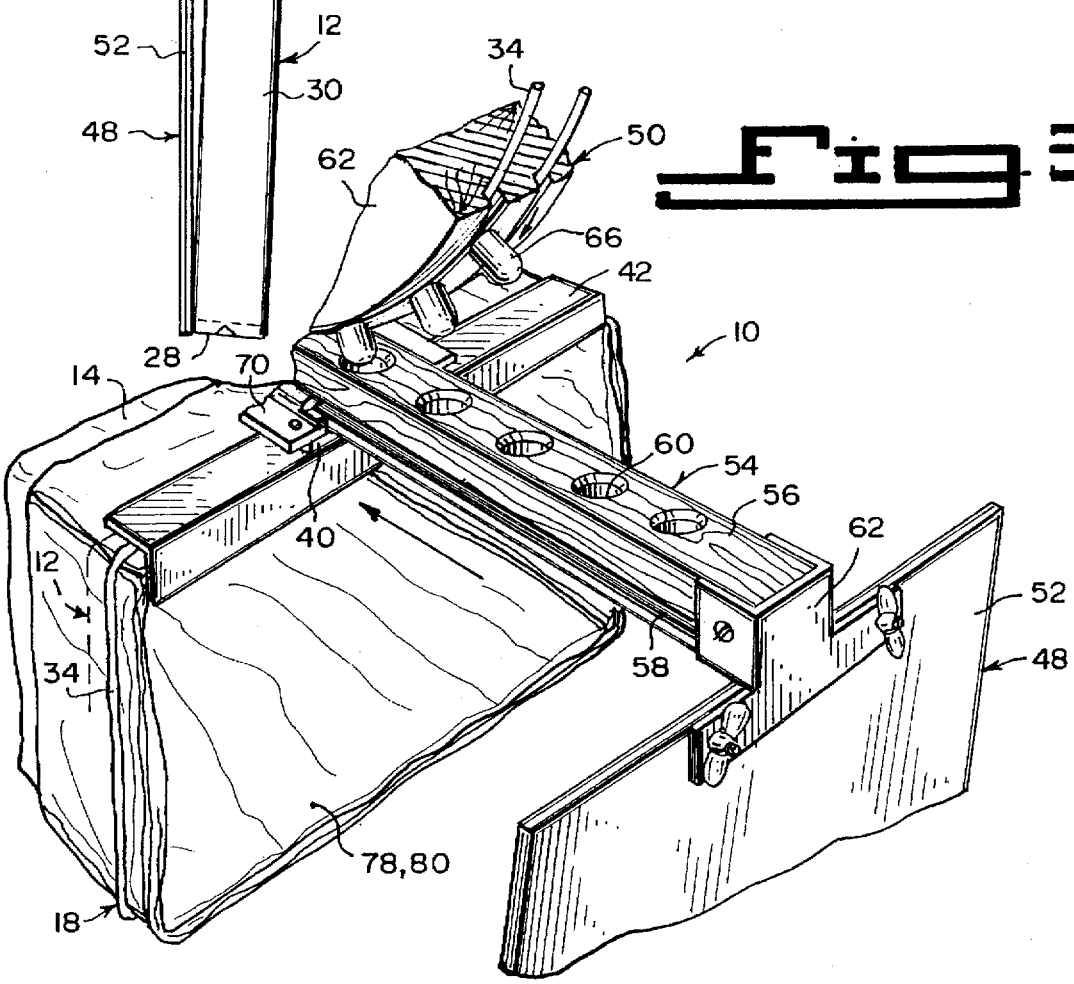
FIG. 3 is a front perspective view taken in the direction of arrow 3 in FIG. 1, with parts broken away and in section.

Turning now descriptively to the drawings, in which similar reference characters denote similar elements throughout the several views, FIGS. 1 through 3 illustrate an apparatus 10 for animal waste collection comprising a frame member 12. A disposable bag 14 is to receive animal waste 16 therein. An element 18 is for connecting a folded over mouth portion of the disposable bag 14 to the frame member 12 in a removable manner. An upright handle assembly 20 is also provided. A facility 22 is for coupling the frame member 12 with the disposable bag 14 to a bottom end of the upright handle assembly 20 in a removable manner. A person 24 can grasp the upright handle assembly 20, position the frame member 12 with the disposable bag 14 adjacent animal waste 16 deposited upon the ground 26, scoop the animal waste 16 into the disposable bag 14, disengage the upright handle assembly 20 from the frame member 12 and separate the disposable bag 14 from the frame member 12, to get rid of the disposable bag 14 with the animal waste 16.

The frame member 12, as shown in FIG. 2, is an opened ended rectangular shaped body which includes a bottom wall 28 and a pair of side walls 30. Each side wall 30 extends upwardly from one end of the bottom wall 28. A top wall 32 extends across top ends of the side walls 30, so that the folded over mouth portion of the disposable bag 14 can fit thereabout. The connecting element 18 is a rubber band 34, to hold the folded over mouth portion of the disposable bag 14 in place on the frame member 12.

The upright handle assembly 20 consists of an elongated shaft 36. A pair of L-shaped stanchion braces 38 are affixed on opposite sides and at a bottom end of the elongated shaft 36. A main stand and stopper 40 is attached to bottom ends of the stanchion braces 38. A C-shaped channel connector 42 is secured to the main stand and stopper 40.

The coupling facility 22 includes a hinged receiver and lock 44 secured to the top wall 32 of the frame member 12. A spring 46 is carried in the hinged receiver and lock 44. The top wall 32 of the frame member 12 can engage with the C-shaped channel connector 42, while the spring 46 will bias the hinged receiver and lock 44 upward, to make contact with a bottom surface of the main stand and stopper 40.

A component 48 is for covering the folded over mouth portion of the disposable bag 14 on the frame member 12. A system 50 is for actuating the covering component 48. The covering component 48 can go from an open position to a closed position. The movement of the covering component 48 will help scoop the animal waste 16 into the disposable bag 14.

The covering component 48 is a pusher plate 52, sized to fit across the folded over mouth portion of the disposable bag 14 on the frame member 12. The actuating system 50 is a rack and pinion assemblage 54, extending between a lower portion of the upright handle assembly 20 and the covering component 48. When rack and pinion assemblage 54 is activated, the covering component 48 will close over the folded over mouth portion of the disposable bag 14 on the frame member 12.

The rack and pinion assemblage 54 consists of the rack being an elongated arm 56, having a pair of longitudinal grooves 58 extending along opposite sides of the arm 56. A plurality of spaced apart holes 60 are along a top surface of the arm 56. The arm 56 slides horizontally between the pair of stanchion braces 38 on the upright handle assembly 20. A bracket 62 on a first end of the arm 56 is connected to a top portion of the covering component 48.

The pinion is a cogwheel 62, having a flat stop portion 64 and a plurality of cogs 66 extending about the rim of the cogwheel 62. The cogwheel 62 is pivotally mounted at 68 between the stanchion braces 38. When the cogwheel 62 rotates, the cogs 66 can engage with the holes 60 in the arm 56, to cause the arm 56 to slide horizontally and move the covering component 48 towards and away from the folded over mouth portion of the disposable bag 14 on the frame member 12. A pair of slide guides 70 are mounted to the main stand and stopper 40 of the upright handle assembly 20. The slide guides 70 can engage with the grooves 58 in the arm 56, to maintain the arm 56 in its horizontal position when the arm 56 slides between the stanchion braces 38.

A connector 72 is pivotally connected to the cogwheel 62. A wire rod 74 is pivotally connected at a bottom end to the connector 72 and extends upwardly along the elongated shaft 36 of the upright handle assembly 20. A loose wire loop handle 76 is formed on a top end of the wire rod 74 and extends about the elongated shaft 36. When the person 24 pulls up on the loose wire loop handle 76, the wire rod 74 via the connector 72 will cause the cogwheel 62 to rotate in a first direction to move the arm 56 horizontally, causing the covering component 48 to move vertically towards the folded over mouth portion of the disposable bag 14 on the frame member 12.

Another rubber band 34 is connected between one cog 66 on the cogwheel 62 opposite from the connector 72 and the elongated shaft 36 of the upright handle assembly 20. The rubber band 34 will cause the cogwheel 62 to rotate in a second opposite direction, to move the arm 56 horizontally causing the covering component 48 to move vertically away from the folded over mouth portion of the disposable bag 14 on the frame member 12.

The disposable bag 14 can be made out of a thin flexible plastic material 78. The disposable bag 14 can also be made out of a thin flexible paper material 80.

LIST OF REFERENCE NUMBERS

10 apparatus
12 frame member
14 disposable bag
16 animal waste
18 connecting element
20 upright handle assembly

22 coupling facility
24 person
26 ground
28 bottom wall of 12
30 side wall of 12
32 top wall of 12
34 rubber band for 18
36 elongated shaft of 20
38 L-shaped stanchion brace of 20
40 main stand and stopper of 20
42 C-shaped channel connector of 20
44 hinged receiver and lock of 22
46 spring of 22
48 covering component
50 actuating system
52 pusher plate for 48
54 rack and pinion assemblage for 50
56 elongated arm of 54
58 longitudinal groove in 56
60 hole in 56
62 cogwheel of 54
64 flat stop portion on 62
66 cog on 62
68 pivot
70 slide guide of 54
72 connector on 62
74 wire rod on 72
76 loose wire loop handle on 72

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for animal waste collection comprising:

a) a frame member;

b) a disposable bag to receive animal waste therein;

c) means for connecting a folded over mouth portion of said disposable bag to said frame member in a removable manner;

d) an upright handle assembly including:

1) an elongated shaft;

2) a pair of L-shaped stanchion braces affixed on opposite sides and at a bottom end of said elongated shaft;

3) a main stand and stopper attached to bottom ends of said stanchion braces; and 4) a C-shaped channel connector secured to said main stand and stopper; and e) means for coupling said frame member with said disposable bag to a bottom end of said upright handle assembly in a removable manner, whereby a person can grasp said upright handle assembly, position said frame member with said disposable bag adjacent animal waste deposited upon the ground, scoop the animal waste into said disposable bag, disengage said upright handle assembly from said frame member and separate said disposable bag from said frame member to get rid of said disposable bag with the animal waste.

2. An apparatus for animal waste collection as recited in claim 1, wherein said frame member is an opened ended rectangular shaped body which includes:

a) a bottom wall;

b) a pair of side walls, in which each said side wall extends upwardly from one end of said bottom wall; and c) a top wall extending across top ends of said side walls, so that the folded over mouth portion of said disposable bag can fit thereabout.

3. An apparatus for animal waste collection as recited in claim 1, wherein said connecting means is a rubber band to hold the folded over mouth portion of said disposable bag in place on said frame member.

4. An apparatus for animal waste collection as recited in claim 1, wherein said coupling means includes:

a) a hinged receiver and lock secured to a top wall of said frame member; and b) a spring carried in said hinged receiver and lock, so that said top wall of said frame member can engage with said C-shaped channel connector, while said spring will bias said hinged receiver and lock upward to make contact with a bottom surface of said main stand and stopper.

5. An apparatus for animal waste collection as recited in claim 1, wherein said disposable bag is made out of a thin flexible plastic material.

6. An apparatus for animal waste collection as recited in claim 1, wherein said disposable bag is made out of a thin flexible paper material.

7. An apparatus for animal waste collection comprising:

a) a frame member;

b) a disposable bag to receive animal waste therein;

c) means for connecting a folded over mouth portion of said disposable bag to said frame member in a removable manner;

d) an upright handle assembly;

e) means for coupling said frame member with said disposable bag to a bottom end of said upright handle assembly in a removable manner, whereby a person can grasp said upright handle assembly, position said frame member with said disposable bag adjacent animal waste deposited upon the ground, scoop the animal waste into said disposable bag, disengage said upright handle assembly from said frame member and separate said disposable bag from said frame member to get rid of said disposable bag with the animal waste, f) means for covering the folded over mouth portion of said disposable bag on said frame member; and g) means for actuating said covering means so that said covering means can go from an open position to a closed position, whereby the movement of said covering means will help scoop the animal waste into said disposable bag, wherein said actuating means is a rack and pinion assemblage extending between a lower portion of said upright handle assembly and said covering means, so that when rack and pinion assemblage is activated said covering means will close over the folded over mouth portion of said disposable bag on said frame member.

8. An apparatus for animal waste collection as recited in claim 7, wherein said covering means is a pusher plate sized to fit across the folded over mouth portion of said disposable bag on said frame member.

9. An apparatus for animal waste collection as recited in claim 7, wherein said rack and pinion assemblage includes:

a) said rack being an elongated arm having a pair of longitudinal grooves extending along opposite sides of said arm and a plurality of spaced apart holes along a top surface of said arm, whereby said arm slides horizontally between a pair of stanchion braces on said upright handle assembly;

b) a bracket on a first end of said arm connected to a top portion of said covering means;

c) said pinion being a cogwheel having a flat stop portion and a plurality of cogs extending about the rim of said cogwheel, said cogwheel pivotally mounted between said stanchion braces, so that when said cogwheel rotates, the cogs can engage with the holes in said arm to cause said arm to slide horizontally and move said covering means towards and away from the folded over mouth portion of said disposable bag on said frame member; and d) a pair of slide guides mounted to a main stand and stopper of said upright handle assembly, so that said slide guides can engage within the grooves in said arm, to maintain said arm in its horizontal position when said arm slides between said stanchion braces.

10. An apparatus for animal waste collection as recited in claim 9, further including:

a) a connector pivotally connected to said cogwheel;

b) a wire rod pivotally connected at a bottom end to said connector and extending upwardly along an elongated shaft of said upright handle assembly;

c) a loose wire loop handle formed on a top end of said wire rod and extending about said elongated shaft, so that when a person pulls up on said loose wire loop handle, said wire rod via said connector will cause said cogwheel to rotate in a first direction to move said arm horizontally causing said covering component to move vertically towards the folded over mouth portion of said disposable bag on said frame member.

11. An apparatus for animal waste collection as recited in claim 10, further including a rubber band connected between one said cog on said cogwheel opposite from said connector and said elongated shaft of said upright handle assembly, whereby said rubber band will cause said cogwheel to rotate in a second opposite direction to move said arm horizontally causing said covering component to move vertically away from the folded over mouth portion of said disposable bag on said frame member.

12. An apparatus for animal waste collection comprising:

a) a disposable bag to receive animal waste therein;

b) a frame member having an opened ended rectangular shaped body which includes:

1) a bottom wall;

2) a pair of side walls, in which each said side wall extends upwardly from one end of said bottom wall; and 3) a top wall extending across top ends of said side walls, so that the folded over mouth portion of said disposable bag can fit thereabout;

c) means for connecting a folded over mouth portion of said disposable bag to said frame member in a removable manner, wherein said connecting means is a rubber band to hold the folded over mouth portion of said disposable bag in place on said frame member;

d) an upright handle assembly including:

1) an elongated shaft;

2) a pair of L-shaped stanchion braces affixed on opposite sides and at a bottom end of said elongated shaft;

3) a main stand and stopper attached to bottom ends of said stanchion braces; and 4) a C-shaped channel connector secured to said main stand and stopper; and e) means for coupling said frame member with said disposable bag to a bottom end of said upright handle assembly in a removable manner, whereby a person can grasp said upright handle assembly, position said frame member with said disposable bag adjacent animal waste deposited upon the ground, scoop the animal waste into said disposable bag, disengage said upright handle assembly from said frame member and separate said disposable bag from said frame member to get rid of said disposable bag with the animal waste.

13. An apparatus for animal waste collection as recited in claim 12, wherein said coupling means includes:

a) a hinged receiver and lock secured to a top wall of said frame member; and b) a spring carried in said hinged receiver and lock, so that said top wall of said frame member can engage with said C-shaped channel connector, while said spring will bias said hinged receiver and lock upward to make contact with a bottom surface of said main stand and stopper.

14. An apparatus for animal waste collection as recited in claim 13, further including:

a) means for covering the folded over mouth portion of said disposable bag on said frame member; and b) means for actuating said covering means so that said covering means can go from an open position to a closed position, whereby the movement of said covering means will help scoop the animal waste into said disposable bag.

15. An apparatus for animal waste collection as recited in claim 14, wherein said covering means is a pusher plate sized to fit across the folded over mouth portion of said disposable bag on said frame member.

16. An apparatus for animal waste collection as recited in claim 15, wherein said actuating means is a rack and pinion assemblage extending between a lower portion of said upright handle assembly and said covering means, so that when rack and pinion assemblage is activated said covering means will close over the folded over mouth portion of said disposable bag on said frame member.

17. An apparatus for animal waste collection as recited in claim 16, wherein said rack and pinion assemblage includes:

a) said rack being an elongated arm having a pair of longitudinal grooves extending along opposite sides of said arm and a plurality of spaced apart holes along a top surface of said arm, whereby said arm slides horizontally between a pair of stanchion braces on said upright handle assembly;

b) a bracket on a first end of said arm connected to a top portion of said covering means;

c) said pinion being a cogwheel having a flat stop portion and a plurality of cogs extending about the rim of said cogwheel, said cogwheel pivotally mounted between said stanchion braces, so that when said cogwheel rotates, the cogs can engage with the holes in said arm to cause said arm to slide horizontally and move said covering means towards and away from the folded over mouth portion of said disposable bag on said frame member; and d) a pair of slide guides mounted to a main stand and stopper of said upright handle assembly, so that said slide guides can engage within the grooves in said arm, to maintain said arm in its horizontal position when said arm slides between said stanchion braces.

18. An apparatus for animal waste collection as recited in claim 17, further including:

a) a connector pivotally connected to said cogwheel;

b) a wire rod pivotally connected at a bottom end to said connector and extending upwardly along an elongated shaft of said upright handle assembly;

c) a loose wire loop handle formed on a top end of said wire rod and extending about said elongated shaft, so that when a person pulls up on said loose wire loop handle, said wire rod via said connector will cause said cogwheel to rotate in a first direction to move said arm horizontally causing said covering component to move vertically towards the folded over mouth portion of said disposable bag on said frame member.

19. An apparatus for animal waste collection as recited in claim 18, further including a rubber band connected between one said cog on said cogwheel opposite from said connector and said elongated shaft of said upright handle assembly, whereby said rubber band will cause said cogwheel to rotate in a second opposite direction to move said arm horizontally causing said covering component to move vertically away from the folded over mouth portion of said disposable bag on said frame member.

20. An apparatus for animal waste collection as recited in claim 19, wherein said disposable bag is made out of a thin flexible plastic material.

21. An apparatus for animal waste collection as recited in claim 19, wherein said disposable bag is made out of a thin flexible paper material.

* * * * *